US008701328B2

(12) United States Patent
Sohn

(10) Patent No.: US 8,701,328 B2
(45) Date of Patent: Apr. 22, 2014

(54) BIDIRECTIONAL GUN BORE CLEANING DEVICE USING MANUAL IMPACT FORCE

(76) Inventor: Won Ho Sohn, Seoul (KR)

( * ) Notice: Subject to any disclaimer, the term of this patent is extended or adjusted under 35 U.S.C. 154(b) by 0 days.

(21) Appl. No.: 13/990,188

(22) PCT Filed: Sep. 27, 2011

(86) PCT No.: PCT/KR2011/007102

§ 371 (c)(1),
(2), (4) Date: May 29, 2013

(87) PCT Pub. No.: WO2012/108603

PCT Pub. Date: Aug. 16, 2012

(65) Prior Publication Data

US 2013/0239452 A1 Sep. 19, 2013

(30) Foreign Application Priority Data

Feb. 10, 2011 (KR) ..... 10-2011-0011947

(51) Int. Cl.
*F41A 29/02* (2006.01)

(52) U.S. Cl.
USPC ..... 42/95; 15/104.16

(58) Field of Classification Search
USPC ..... 42/95; 15/104.16
See application file for complete search history.

(56) References Cited

U.S. PATENT DOCUMENTS

| | | | | | |
|---|---|---|---|---|---|
| 268,004 | A | * | 11/1882 | Davis | 401/9 |
| 1,516,438 | A | * | 11/1924 | Inskip | 15/104.16 |
| 2,544,847 | A | * | 3/1951 | Malesky | 15/104.165 |
| 4,866,871 | A | * | 9/1989 | Rivers | 42/95 |
| 6,269,579 | B1 | | 8/2001 | Warner | |

FOREIGN PATENT DOCUMENTS

| | | | |
|---|---|---|---|
| KR | 10-1994-0020093 | A | 9/1994 |
| KR | 10-2000-0039709 | A | 7/2000 |
| KR | 10-2002-0034131 | A | 5/2002 |
| KR | 10-2006-0098356 | | 10/2006 |
| KR | 10-0963166 | | 6/2010 |

OTHER PUBLICATIONS

International Search Report for PCT/ KR2011/007102 mailed Apr. 30, 2012 from Korean Intellectual Property Office.

* cited by examiner

*Primary Examiner* — Michael Carone
*Assistant Examiner* — Reginald Tillman, Jr.
(74) *Attorney, Agent, or Firm* — Sherr & Jiang, PLLC

(57) ABSTRACT

Disclosure relates to a bidirectional gun bore cleaning device for rapidly cleaning the bore of a gun barrel with less manpower by using a striking force (impact energy) of a striking hammer to easily move a cleaning brush in the bore. The bidirectional gun bore cleaning device is coupled to an end of the existing cleaning rod when being used.

3 Claims, 3 Drawing Sheets

BIDIRECTIONAL GUN BORE CLEANING DEVICE USING MANUAL IMPACT FORCE

CROSS REFERENCE TO PRIOR APPLICATION

This application is a National Stage Patent Application of PCT International Patent Application No. PCT/KR2011/007102 (filed on Sep. 27, 2011) under 35 U.S.C. §371, which claims priority to Korean Patent Application No. 10-2011-0011947 (filed on Feb. 10, 2011), which are all hereby incorporated by reference in their entirety.

TECHNICAL FIELD

The present invention relates to a gun bore cleaning device necessary for a gun weapon system for keeping the bore (inside) of a gun barrel clean when soldiers operate guns for firing, and more particularly, to a bidirectional gun bore cleaning device for rapidly cleaning the bore of a gun barrel with less manpower by using a striking force (impact energy) of a striking hammer to easily move a cleaning brush in the bore. The bidirectional gun bore cleaning device can simply be coupled to an end of the existing cleaning rod when being used.

BACKGROUND ART

In field battles, the barrels of guns may be the most important parts determining the performance of the guns and thus should be kept clean for any shooting. In general, a gun weapon system includes howitzers, direct-firing guns, tank guns, antiaircraft guns, and mortars each having an appropriate barrel. If a gun is fired in a state where the barrel of the gun is not clean, fatal problems such as barrel bursting may occur as well as the velocity and range of bombs being affected. In addition, if a gun is left for a long tie without cleaning after firing, the inside of the barrel may rust because of remaining gunpowder or soot.

Although gun weapon systems have been significantly developed owing to the advance in scientific technology, the development of techniques or methods for cleaning gun barrels has not kept pace with the development of gun weapon systems, and thus soldiers have to manually clean gun barrels by attaching a brush to a cleaning rod shaped like a long pole, inserting the cleaning rod into the bore of a barrel, and repeatedly pulling and pushing the cleaning rod in the bore. When cleaning the inside of a gun barrel, a strong frictional force acts between the brush and the rifling on the bore of the gun barrel, and thus the cleaning rod has to be moved against the frictional force which increases the manpower and time necessary for cleaning the gun barrel. For example, seven to twelve soldiers have to work hard for an hour or more to clean the barrel bore of a large-caliber self-propelled gun.

Techniques for solving the above-mentioned problems by efficiently cleaning the bore of a gun barrel with less manpower in shorter time are disclosed in patent applications and issued patents: power devices for automatically cleaning a gun barrel are disclosed in Literatures 1 and 2, and a semiautomatic device for cleaning a gun barrel using a winch is disclosed in Literature 3. The disclosed techniques are considered efficient for cleaning a gun barrel. However, the functions of existing cleaning rods and brushes cannot be fully replaced with such automatic and semiautomatic gun barrel cleaning devices, and thus the existing gun barrel cleaning systems should be used although such new gun barrel cleaning devices are added to respective guns. That is, such an automatic gun barrel cleaning device or a semiautomatic gun barrel cleaning device using a winch cannot be used to efficiently clean the breeches of guns although being used to efficiently clean the rifling on rifled barrels or portions of unrifled barrel through which warheads move. In addition, to remove defective ammunition from the breech, a defective ammunition removing tool has to be attached to a cleaning rod to beat the detective ammunition out of the breech, and thus cleaning rods and brushes are still necessary.

Furthermore, the above-described automatic and semiautomatic gun barrel cleaning devices can be used only for guns of 105 mm or greater calibers. That is, it is impossible or difficult to use such automatic and semiautomatic gun barrel cleaning devices for guns of smaller calibers.

Therefore, there is a need for a method of efficiently cleaning bores of various gun barrels with less manpower in shorter time by using the existing cleaning system including a cleaning rod used for cleaning gun bores, removing defective ammunition, etc.

The barrel bores of small-caliber guns are cleaned using cleaning cloth inserted into a hole formed in an end of a slender rod (cleaning rod). Although the barrel bores of small-caliber guns can be cleaned more efficiently by pushing and pulling stiff brushes such as brass, hog bristle, mane, or stainless brushes in the barrel bores one to five times, it is difficult for a soldier to move such a stiff brush back and forth in the barrel bore. Furthermore, since a slender rod to which cleaning cloth is attached is not tightly inserted in a barrel bore, the slender rod has to be moved back and force in the barrel bore too many times, which abrades the rifling on the barrel bore and thus reduces the lifespan of the barrel.

[Literature 1] Korean Patent Application Publication No.: 10-1998-0055121

[Literature 2] Korean Patent Application Publication No.: 10-2006-0098356

[Literature 3] Korean Patent Registration No.: 0963166

SUMMARY OF INVENTION

Technical Problem

To solve the above-mentioned limitations, the present invention has the following objects.

A first object of the present invention is to provide a device that can be used with the existing clean rod to efficiently clean the bore of a gun barrel with less manpower by a striking method.

A second object of the present invention is to provide a device that can minimize the generation of noise during striking.

A third object of the present invention is to provide a device in which a cleaning brush (610) can be replaced with another one if necessary.

Solution to Problem

To achieve the objects, the present invention is configured as follows.

The present invention provides a bidirectional gun bore cleaning device using a manual impact force and configured to be coupled to an end of a cleaning rod for cleaning a bore of a gun barrel, the bidirectional gun bore cleaning device including: a hollow tubular body (110) including a cleaning rod coupling portion (111) at a rear end thereof for coupling with the end of the cleaning rod (11), and a screw coupling portion (112) at a front end thereof; a striking hammer body (210) including a rear hammer portion (211) having threads for coupling with the screw coupling portion (112) formed on the front end of the tubular body (110), a front hammer portion (212) formed in one piece with the rear hammer portion (211) and protruding forward, and a guide-rod passage hole (213) formed through center regions of the rear hammer portion (211) and the front hammer portion (212); a guide rod (310) inserted in the striking hammer body (210) through the guide-rod passage hole (213) and slidable back and forth therein, the guide rod (310) including a front striking plate coupling portion (311) which is formed at a front end thereof and protrudes forward from the striking hammer body (210); an internal rear striking plate (410) coupled to a rear end of the guide rod (310) and placed in the tubular body (110), the internal rear striking plate (410) functioning as a weight; a front striking plate (510) including a striking face (511) formed on a rear end thereof and coupled to the front striking plate coupling portion (311) of the guide rod (310) for being struck by the front hammer portion (212) of the striking hammer body (210), and a cleaning brush coupling portion (512) formed on a front end thereof; and a cleaning brush (610) coupled to the cleaning brush coupling portion (512) of the front striking plate (510), wherein if the cleaning rod (11) is pushed toward, the front hammer portion (212) of the striking hammer body (210) collides with the striking face (511) of the front striking plate (510) so that a striking force is transmitted to the cleaning brush (610), and if the cleaning rod (11) is pulled backward, a rear end of the rear hammer portion (211) of the striking hammer body (210) collides with the internal rear striking plate (410) so that a striking force is transmitted to the cleaning brush (610).

[Reference Signs List]

| | |
|---|---|
| 110: tubular body | |
| 111: cleaning rod coupling portion | 112: screw coupling portion |
| 210: striking hammer body | |
| 211: rear hammer portion | 212: front hammer portion |
| 213: guide-rod passage hole | |
| 310: guide rod | |
| 311: front striking plate coupling portion | |
| 410: inner rear striking plate | |
| 510: front striking plate | |
| 511: striking face | 512: cleaning brush coupling portion |
| 610: cleaning brush | |
| 710: subsidiary weight structure | 711: first screw portion |
| 712: second screw portion | 713: mounting groove portion |
| 720: coil spring | |
| 11: cleaning rod | |

DESCRIPTION OF EMBODIMENTS

Exemplary embodiments of the present invention will now be described in detail with reference to the accompanying drawings.

Figure 1:
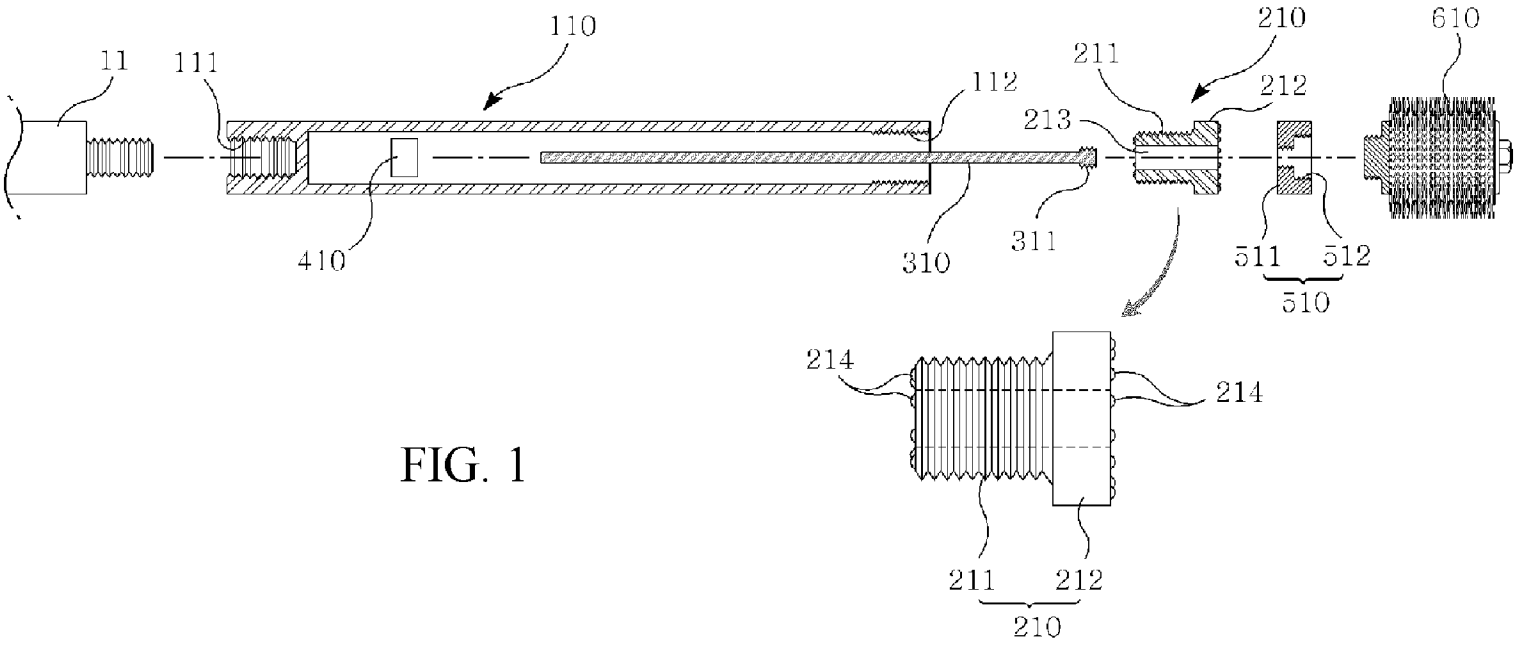
FIG. 1 is a sectional view illustrating separated main parts according to an exemplary embodiment of the present invention.
Figure 2:
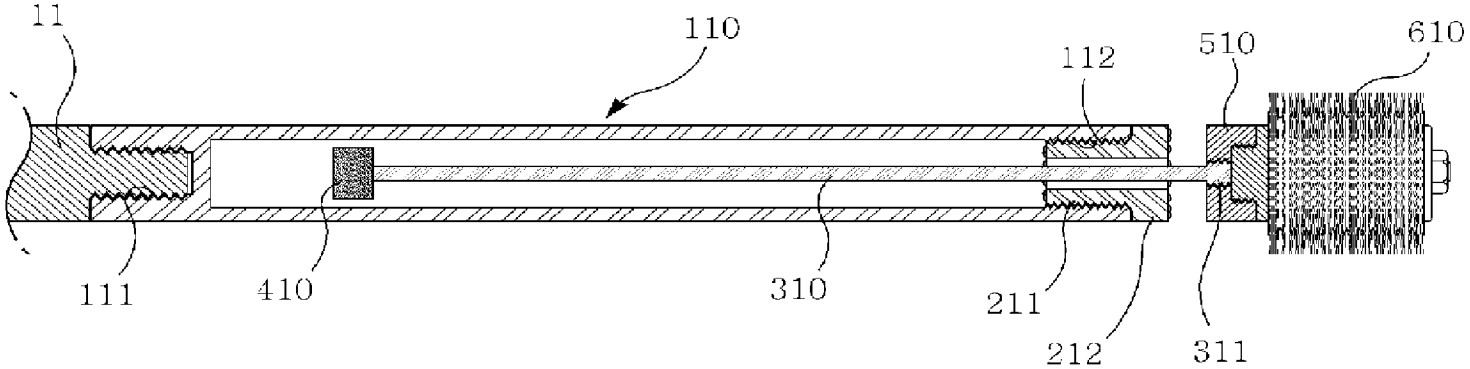
FIG. 2 is a sectional view illustrating the main parts assembled according to the exemplary embodiment of the present invention.

The present invention relates to a bidirectional gun bore cleaning device using a manual impact force and configured to be coupled to an end of a cleaning rod used to clean the bore of a gun barrel. FIG. 1 is a sectional view illustrating separated main parts according to an exemplary embodiment of the present invention, and FIG. 2 is a sectional view illustrating the main parts assembled according to the exemplary embodiment of the present invention. The main parts of the present invention may be formed of various metallic materials.

A tubular body 110 has a hollow tubular shape.

A cleaning rod coupling portion 111 is provided on a rear end of the tubular body 110 so that a cleaning rod 11 can be coupled to the cleaning rod coupling portion 111. As shown in FIGS. 1 and 2, the cleaning rod coupling portion 111 has an internal thread portion corresponding to a screw portion on an end of the cleaning rod 11. If the screw portion is not formed on the end of the cleaning rod 11, the cleaning rod coupling portion 111 may have a different shape corresponding to the shape of the end of the cleaning rod 11 for coupling with the end of the cleaning rod 11.

A screw coupling portion 112 is provided on a front end of the tubular body 110 for coupling with a rear hammer portion 211.

A striking hammer body 210 is configured to be coupled to the front end of the tubular body 110, and the striking hammer body 210 includes the rear hammer portion 211 and a front hammer portion 212.

The rear hammer portion 211 includes threads for coupling with the screw coupling portion 112 of the tubular body 110.

The front hammer portion 212 and the rear hammer portion 211 are formed in one piece, and the front hammer portion 212 extends forward and functions as a weight.

A guide-rod passage hole 213 is formed through the center regions of the rear hammer portion 211 and the front hammer portion 212 so that a guide rod 310 can slide back and forth in the guide-rod passage hole 213.

The guide rod 310 is inserted in the guide-rod passage hole 213 of the striking hammer body 210 and is slidable back and forth in the guide-rod passage hole 213. A front striking plate coupling portion 311 is provided on a front end of the guide rod 310, and the front striking plate coupling portion 311 protrudes forward from the striking hammer body 210. As shown in FIGS. 1 and 2, the front striking plate coupling portion 311 may be threaded. However, the front striking plate coupling portion 311 is not limited thereto. For example, if a front striking plate 510 has no threaded portion, the front striking plate coupling portion 311 may have any other shape correspond to the shape of the front striking plate 510 for coupling with the front striking plate 510.

An internal rear striking plate 410 is coupled to a rear end of the guide rod 310 and placed in the tubular body 110 so as to be struck by the rear hammer portion 211. The internal rear striking plate 410 and the guide rod 310 may be coupled to each other by any method such as thread coupling, welding, and pin coupling. Alternatively, the internal rear striking plate 410 and the guide rod 310 may be formed in one piece.

A rear face of the front striking plate 510 is coupled to the front striking plate coupling portion 311 of the guide rod 310 as a striking face 511 which the front hammer portion 212 of the striking hammer body 210 strikes.

A cleaning brush coupling portion 512 is formed on a front end of the front striking plate 510. The cleaning brush coupling portion 512 may be threaded as shown in FIGS. 1 and 2. However, the cleaning brush coupling portion 512 is not limited thereto. For example, if a cleaning brush 610 has no threaded portion, the cleaning brush coupling portion 512 may have any other shape corresponding to the shape of the cleaning brush 610 for coupling with the cleaning brush 610.

The cleaning brush 610 is configured to be coupled to the cleaning brush coupling portion 512 of the front striking plate 510. The shape of the cleaning brush 610 is not limited to the shape shown in FIGS. 1 and 2. That is, the cleaning brush 610 may have any other shape suitable for cleaning the inside of a gun barrel, and cleaning brushes and cloth scraps having different sizes (types) may be prepared for guns of various calibers.

The cleaning brush 610 may be replaced with another one if necessary in the field.

In the assembled state shown in FIG. 2, the cleaning brush 610 is inserted in the entrance of a barrel bore, and then if the cleaning rod 11 is pushed toward, the front hammer portion 212 of the striking hammer body 210 collides with the striking face 511 of the front striking plate 510 so that a striking force can be transmitted to the cleaning brush 610 to move the cleaning brush 610 toward. Thereafter, if the cleaning rod 11 is pulled backward, a rear end of the rear hammer portion 211 of the striking hammer body 210 collides with the internal rear striking plate 410 so that a striking force can be transmitted to the cleaning brush 610 to move the cleaning brush 610 backward.

In this way, as the cleaning rod 11 is moved back and forth, striking forces can be efficiently transmitted to the cleaning brush 610 for facilitating frictional movement of the cleaning brush 610 in the barrel bore, and thus the barrel bore can be efficiently cleaned with less manpower.

A plurality of protrusions 214 may be formed on a rear face of the rear hammer portion 211 and a front face of the front hammer portion 212 of the striking hammer body 210 so as to reduce contact areas and noise during striking.

Figure 3:
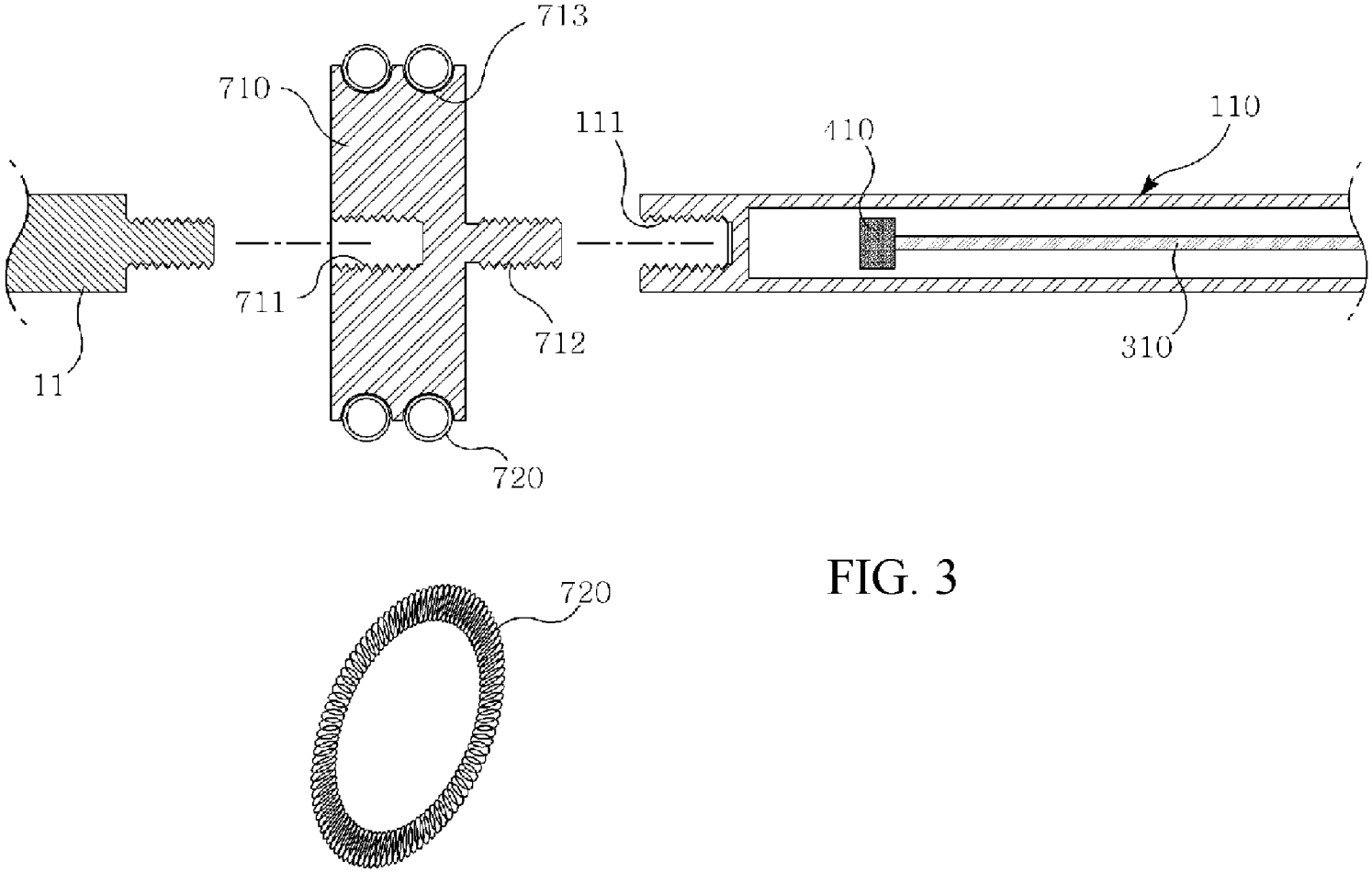
FIG. 3 is a sectional view illustrating another exemplary embodiment of the present invention to which a subsidiary weight structure 710 is added.

FIG. 3 is a sectional view illustrating another exemplary embodiment of the present invention to which a subsidiary weight structure 710 is added.

The subsidiary weight structure 710 includes: a first screw portion 711 in a rear center region for coupling with the end of the cleaning rod 11; and a second screw portion 712 on a front center region for coupling with the cleaning rod coupling portion 111, so that the subsidiary weight structure 710 can be connected between the end of the cleaning rod 11 and the rear end of the tubular body 110.

The diameter of the subsidiary weight structure 710 is greater than that of the tubular body 110 but smaller than that of the cleaning brush 610, and a mounting groove portion 713 is formed on the outer side of the subsidiary weight structure 710.

Coil springs 720 are fitted to the mounting groove portion 713 around the subsidiary weight structure 710.

Since the diameter of the subsidiary weight structure 710 is smaller than the inner diameter of a gun barrel, the subsidiary weight structure 710 can be inserted in the gun barrel together with the cleaning brush 610.

When the guide rod 310 is fully pushed forward, the subsidiary weight structure 710 prevents bending at the front end of the tubular body 110. The reason for this is that the subsidiary weight structure 710 and the cleaning brush 610 are supported on the inner side of the gun barrel.

The coil springs 720 prevent the subsidiary weight structure 710 from directly making contact with the inner side of the gun barrel so as to minimize friction when the subsidiary weight structure 710 is moved back and forth. In addition, a striking force can be increased owing to the weight of the subsidiary weight structure 710. Furthermore, the coil springs 720 may be wrapped with a cleaning cloth strap to clean the inside of a gun barrel. For example, when simply cleaning the inner side of a gun barrel, only the subsidiary weight structure 710 may be coupled to the end of the cleaning rod 11. In addition, the breech of a gun having a relatively large diameter may be efficiently cleaned by replacing the coil springs 720 with other coil springs 720 having a larger diameter and wrapping the larger coil springs 720 with a cleaning cloth strap.

While the present invention has been particularly shown and described with reference to exemplary embodiments thereof, the present invention is not limited to the embodiments. Various design changes, addition or omission of the prior art, and simple numeral limitation may be made within the spirit and scope of the present invention.

INDUSTRIAL APPLICABILITY

The present invention provides the following technical effects.

First, since the striking method can be used with the existing cleaning rod, the bore of a gun barrel can be efficiently cleaned with less manpower.

In other words, the bidirectional gun bore cleaning device can be used by simply coupling the device to the end of the existing cleaning rod so that costs necessary for replacing cleaning tools can be saved, and since the cleaning brush 610 can be easily struck by moving the cleaning rod back and forth, frictional movement of the cleaning brush 610 in the bore of a gun barrel can be easily induced for efficient cleaning with less manpower.

Second, striking noise can be minimized.

That is, owing to the protrusions 214 formed on the rear face of the rear hammer portion 211 and the front face of the front hammer portion 212, contact areas and noise can be reduced during striking.

Third, if necessary, various cleaning brushes 610 can be used to carry out a cleaning operation easily and efficiently.

The invention claimed is:

1. A bidirectional gun bore cleaning device using a manual impact force and configured to be coupled to an end of a cleaning rod for cleaning a bore of a gun barrel, the bidirectional gun bore cleaning device comprising:

a hollow tubular body (110) comprising a cleaning rod coupling portion (111) at a rear end thereof for coupling with the end of the cleaning rod (11), and a screw coupling portion (112) at a front end thereof;

a striking hammer body (210) comprising a rear hammer portion (211) having threads for coupling with the screw coupling portion (112) formed on the front end of the tubular body (110), a front hammer portion (212) formed in one piece with the rear hammer portion (211) and protruding forward, and a guide-rod passage hole (213) formed through center regions of the rear hammer portion (211) and the front hammer portion (212);

a guide rod (310) inserted in the striking hammer body (210) through the guide-rod passage hole (213) and slidable back and forth therein, the guide rod (310) comprising a front striking plate coupling portion (311) which is formed at a front end thereof and protrudes forward from the striking hammer body (210);

an internal rear striking plate (410) coupled to a rear end of the guide rod (310) and placed in the tubular body (110), the internal rear striking plate (410) functioning as a weight;

a front striking plate (510) comprising a striking face (511) formed on a rear end thereof and coupled to the front striking plate coupling portion (311) of the guide rod (310) for being struck by the front hammer portion (212)

of the striking hammer body (210), and a cleaning brush coupling portion (512) formed on a front end thereof; and a cleaning brush (610) coupled to the cleaning brush coupling portion (512) of the front striking plate (510), wherein if the cleaning rod (11) is pushed forward, the front hammer portion (212) of the striking hammer body (210) collides with the striking face (511) of the front striking plate (510) so that a striking force is transmitted to the cleaning brush (610), and if the cleaning rod (11) is pulled backward, a rear end of the rear hammer portion (211) of the striking hammer body (210) collides with the internal rear striking plate (410) so that a striking force is transmitted to the cleaning brush (610).

2. The bidirectional gun bore cleaning device of claim 1, wherein the striking hammer body (210) comprises a plurality of protrusions (214) on a rear face of the rear hammer portion (211) and a plurality of protrusions (214) on a front face of the front hammer portion (212).

3. The bidirectional gun bore cleaning device of claim 1, further comprising:

a subsidiary weight structure (710) comprising a first screw coupling portion (711) formed in a rear center region thereof for coupling with the end of the cleaning rod (11) and a second screw coupling portion (712) formed on a front center region thereof for coupling with the cleaning rod coupling portion (111), the subsidiary weight structure (710) being connected between the end of the cleaning rod (11) and the rear end of the tubular body (110), the subsidiary weight structure (710) having a diameter greater than the tubular body (110) but smaller than the bore of the gun barrel, a mounting groove portion (713) being formed on an outer side of the subsidiary weight structure (710); and a coil spring (720) fitted to the subsidiary weight structure (710) along the mounting groove portion (713) to surround the subsidiary weight structure (710).

* * * * *